US011450267B2

(12) United States Patent
Han et al.

(10) Patent No.: US 11,450,267 B2
(45) Date of Patent: Sep. 20, 2022

(54) BRIGHTNESS COMPENSATION APPARATUS AND METHOD FOR PIXEL POINT

(71) Applicant: BOE TECHNOLOGY GROUP CO., LTD., Beijing (CN)

(72) Inventors: Dongxu Han, Beijing (CN); Tieshi Wang, Beijing (CN); Zhongyuan Wu, Beijing (CN); Yongqian Li, Beijing (CN); Pan Xu, Beijing (CN); Jinxia Hu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 271 days.

(21) Appl. No.: 16/621,937

(22) PCT Filed: Mar. 27, 2019

(86) PCT No.: PCT/CN2019/079898
§ 371 (c)(1),
(2) Date: Dec. 12, 2019

(87) PCT Pub. No.: WO2019/242367
PCT Pub. Date: Dec. 26, 2019

(65) Prior Publication Data

US 2021/0327343 A1 Oct. 21, 2021

(30) Foreign Application Priority Data

Jun. 22, 2018 (CN) ..... 201810654951.9

(51) Int. Cl.
*G09G 3/3225* (2016.01)

(52) U.S. Cl.
CPC ..... *G09G 3/3225* (2013.01); *G09G 2310/027* (2013.01); *G09G 2320/0233* (2013.01); *G09G 2360/16* (2013.01)

(58) Field of Classification Search
CPC ..... G09G 3/3225; G09G 2310/027; G09G 2320/0233; G09G 2360/16
See application file for complete search history.

(56) References Cited

U.S. PATENT DOCUMENTS 8,619,102 B2 12/2013 Chen et al.
9,620,064 B2 4/2017 Albrecht et al.
(Continued)

FOREIGN PATENT DOCUMENTS

CN 107799084 A 3/2018
CN 107958651 A 4/2018
CN 108831374 A 11/2018

OTHER PUBLICATIONS

Search Report dated Feb. 26, 2021 for application No. IN 201927052684 with English translation.
(Continued)

*Primary Examiner* — Kwang-Su Yang
(74) *Attorney, Agent, or Firm* — Nath, Goldberg & Meyer; Joshua R Goldberg

(57) ABSTRACT

Brightness compensation method and apparatus for pixel point are provided. The compensation method includes measurement processes of N times, N≥2. Each measurement process includes: obtaining images displayed on the display screen under different gray-scale signals, and extracting brightness of pixel points in the images; calculating difference parameters between brightness of the pixel points and brightness of the reference pixel point under the different gray-scale signals; fitting the difference parameters of the pixel points with initial brightness of the pixel points under the different gray-scale signals, to obtain initial brightness-difference parameter curves of the pixel points; calculating compensation parameters of the pixel points; during an $(i)^{th}$ measurement process, i=2 to N, images displayed on the display screen under the different gray-scale signals are
(Continued)

obtained by compensating the initial brightness of the pixel points under the different gray-scale signals based on the compensation parameters obtained during an $(i-1)^{th}$ measurement process.

18 Claims, 5 Drawing Sheets

(56) References Cited

U.S. PATENT DOCUMENTS

| | | | | |
|---|---|---|---|---|
| 2007/0030215 | A1* | 2/2007 | Lee | G09G 3/22 345/74.1 |
| 2007/0109321 | A1 | 5/2007 | Yu et al. | |
| 2018/0174518 | A1* | 6/2018 | Suk | G09G 3/3291 |
| 2019/0114973 | A1* | 4/2019 | Zha | G09G 3/2025 |
| 2019/0385544 | A1 | 12/2019 | Tan | |

OTHER PUBLICATIONS

Office Action dated Dec. 3, 2019 issued in corresponding Chinese Application No. 201810654951.9.

* cited by examiner

BRIGHTNESS COMPENSATION APPARATUS AND METHOD FOR PIXEL POINT

CROSS-REFERENCE TO RELATED APPLICATIONS

This application is a U.S. National Stage Application under 35 U.S.C. § 371 of International Patent Application No. PCT/CN2019/079898, filed on Mar. 27, 2019, which claims the priority of the Chinese patent application No. 201810654951.9, filed on Jun. 22, 2018, the disclosure of both is incorporated herein in its entirety by reference.

TECHNICAL FIELD

The disclosure relates to the field of display technology, and in particular, to a brightness compensation method and apparatus for pixel point.

BACKGROUND

An OLED (Organic Light-Emitting Diode) display device is called a most promising display element due to its advantages of self-illumination, high brightness, high contrast, low operating voltage, and flexible display.

It is difficult for an existing production process of an OLED display screen to ensure the brightness uniformity of the full display screen, thereby affecting a yield during the production process. The brightness uniformity of pixel points in the display screen, and thus product yield and quality may be effectively improved through optical compensation. A general process of the optical compensation includes: extracting brightness or contrast of the full-screen pixel points by CCDs (Charge Coupled Device), determining brightness difference between the pixel points and a reference pixel point by an operation, and then compensating the pixel points accordingly, to obtain a substantially uniform brightness of the full-screen pixel points.

SUMMARY

In some embodiments, a brightness compensation method for pixel point is provided, and the brightness compensation method includes measurement processes of N times, N≥2. Each of the measurement processes includes: sequentially inputting different gray-level signals to a display screen, obtaining images displayed on the display screen under the different gray-scale signals, and extracting brightness of pixel points in the images under the different gray-scale signals; determining a reference pixel point from the pixel points, and calculating difference parameters between the brightness of the pixel points and the brightness of the reference pixel point under the different gray-scale signals; fitting the difference parameters of the pixel points with initial brightness of the pixel points under the different gray-level signals, respectively, to obtain initial brightness-difference parameter curves of the pixel points, respectively, wherein the initial brightness of the pixel points is obtained in a first measurement process under the different gray-scale signals; and calculating compensation parameters of the pixel points based on the initial brightness-difference parameter curves of the pixel points; wherein during an $(i)^{th}$ measurement process, i=2 to N, images displayed on the display screen under the different gray-level signals are obtained by compensating the initial brightness of the pixel points under the different gray-level signals based on the compensation parameters obtained during an $(i-1)^{th}$ measurement process.

In some embodiments, the calculating difference parameters between the brightness of the pixel points and the brightness of the reference pixel point under the different gray-scale signals includes: recording the number of the different gray-scale signals, input sequentially to the display screen during each measurement process, being M, M≥2, and the number of the pixel points in the display screen being D;

calculating the difference parameters of each of the pixel points based on the following formula (1):

$$L_j^r = Q_{x,j} * L_{x,j} \tag{1}$$

wherein j=1 to M; x=1 to D; $L_j^r$ is a brightness of the reference pixel point under a $(j)^{th}$ gray-scale signal; $L_{x,j}$ is a brightness of an $(x)^{th}$ pixel point under the $(j)^{th}$ gray-scale signal; $Q_{x,j}$ is a difference parameter between the brightness of the $(x)^{th}$ pixel point and the brightness of the reference pixel point under the $(j)^{th}$ gray-scale signal.

In some embodiments, in the fitting the difference parameters of the pixel points with initial brightness of the pixel points under the different gray-scale signals includes fitting the difference parameters of the pixel points with initial brightness of the pixel points under the different gray-scale signals comprises by linear function fitting; and the calculating compensation parameters of the pixel points based on the initial brightness-difference parameter curves of the pixel points includes:

expressing the initial brightness-difference parameter curve of each of the pixel points by the following formula (2):

$$Q_x = K_x' * L_x^0 + K_x'' \tag{2}$$

wherein $Q_x$ is the difference parameter between the brightness of the $(x)^{th}$ pixel point and the brightness of the reference pixel point under a gray-scale signal; $L_x^0$ is the initial brightness of the $(x)^{th}$ pixel point under the gray-scale signal; and $K_x'$ and $K_x''$ are coefficients;

calculating a value of $K_x'$ as a first compensation parameter of the $(x)^{th}$ pixel point and a value of $K_x''$ as a second compensation parameter of the $(x)^{th}$ pixel point.

In some embodiments, the compensating the initial brightness of the pixel points under the different gray-scale signals includes:

calculating compensated brightness of each of the pixel points under the different gray-scale signals based on the following formula (3):

$$L_{x,j} = K_x' * (L_{x,j}^0)^2 + K_x'' * L_{x,j}^0 \tag{3}$$

wherein $L_{x,j}$ is the compensated brightness of the $(x)^{th}$ pixel point under the $(j)^{th}$ gray-scale signal; $L_{x,j}^0$ is the initial brightness of the $(x)^{th}$ pixel point under the $(j)^{th}$ gray-scale signal; and $K_x'$ and $K_x''$ are compensation parameters obtained in the $(i-1)^{th}$ measurement process;

obtaining compensated gray-scale signals of the pixel points corresponding to the compensated brightness under the different gray-scale signals based on a correspondence between a gray-scale signal and a brightness; and converting multiple gray-scale signals, which are intended to be sequentially input to the display screen, into compensated gray-scale signals for the pixel points, such that the pixel points display with the compensated brightness, respectively.

In some embodiments, the brightness compensation method for pixel point further includes: during an actual display of the display screen, obtaining uncompensated brightness of the pixel points in an image to be displayed on the display screen;

retrieving the compensation parameters obtained during the $(N)^{th}$ measurement process;

calculating compensated brightness of each of the pixel points based on the following formula (4):

$$L_x=K_{x,N}'*(L_x^0)^2+K_{x,N}''*L_x^0 \quad (4)$$

wherein $L_x$ is the compensated brightness of the $(x)^{th}$ pixel point; $L_x^0$ is the uncompensated brightness of the $(x)^{th}$ pixel point; $K_{x,N}'$ is a first compensation parameter of the $(x)^{th}$ pixel point obtained during the $(N)^{th}$ measurement process; $K_{x,N}''$ is a second compensation parameter of the $(x)^{th}$ pixel obtained during the $(N)^{th}$ measurement process;

obtaining the compensated gray-scale signals of the pixel points corresponding to the compensated brightness based on the correspondence between the gray-scale signal and the brightness; and inputting the compensated gray-scale signals to the pixel points to cause the pixel points to display with the compensated brightness, respectively.

In some embodiments, the brightness compensation method for pixel point further includes storing the compensation parameters into a drive controller of the display screen after obtaining the compensation parameter at the end of each measurement process.

In some embodiments, the compensation parameters obtained during the $(i)^{th}$ measurement process overlay the compensation parameters obtained during the $(i-1)^{th}$ measurement process.

In some embodiments, the number of the different gray-scale signals input to the display screen during each measurement process is one of 2 to 8.

In some embodiments, a brightness compensation apparatus for pixel point is provided. The brightness compensation apparatus for pixel point includes: a signal generator configured to generate different gray-scale signals and sequentially output the generated different gray-scale signals to a display screen; an image acquisition device configured to acquire images displayed on the display screen under the different gray-scale signals during each measurement process; a processor coupled to the image acquisition device, and configured to extract brightness of the pixel points from the images under the different gray-scale signals and to calculate compensation parameters of the pixel points based on the extracted brightness during each measurement process; and the processor further being coupled to the signal generator and configured to control the signal generator to generate the different gray-scale signals; a memory coupled to the processor and configured to store the compensation parameters obtained during a current measurement process at the end of the current measurement process; a compensation component coupled between the signal generator and the display screen, wherein the compensation component is further coupled to the memory, configured to retrieve, during a measurement process, compensation parameters obtained during a previous measurement process from the memory and to compensate the initial brightness of the pixel points under the different gray-scale signals based on the compensation parameters, such that the display screen displays compensated images, wherein the initial brightness is the brightness of the pixel points under the different gray-scale signals obtained during a first measurement process; and the compensation component is further configured to retrieve compensation parameters from the memory during a last measurement process and to compensate the brightness of the pixel points intended to display during an actual display of the display screen.

In some embodiments, the brightness compensation apparatus for pixel point further includes a data writing device coupled between the processor and the memory, and configured to write the compensation parameters obtained during each measurement process to the memory.

In some embodiments, the memory and the compensation component are integrated in a drive controller of the display screen.

In some embodiments, a computer product is provided. The computer product includes one or more processors, the one or more processors being configured to execute computer instructions to perform one or more steps of the brightness compensation method for pixel point above.

In some embodiments, a computer readable storage medium is provided. Computer executable instructions are stored on the computer readable storage medium, wherein when the computer executable instructions are executed by one or more processors, the computer executable instructions causes the one or more processors to perform one or more steps of the brightness compensation method for pixel point above.

BRIEF DESCRIPTION OF THE DRAWINGS

In order to more clearly illustrate the embodiments of the present disclosure or the technical solutions in the prior art, the drawings to be used in the embodiments or the prior art will be briefly described below. Obviously, the drawings in the following are only embodiments of the present disclosure, and other drawings may be obtained therefrom by those skilled in the art without any creative work.

DETAILED DESCRIPTION

In order to make the above purposes, characteristics and advantages of the present disclosure more obvious and easy to be understood, the technical solution in the embodiments of the present disclosure will be clearly and completely described in conjunction with the drawings in the embodiments of the present disclosure. It is apparent that, the described embodiments are only a part of the embodiments of the present disclosure, and not all of them. All other embodiments obtained by those skilled in the art without any creative work based on the embodiments of the present disclosure fall in the scope of the disclosure.

Just as described in the background art, a conventional optical compensation method implements brightness compensation by: extracting brightness or contrast of the full-screen pixel points by CCDs, determining brightness difference between the pixel points and a reference pixel point, and then compensating the pixel points accordingly based on the brightness difference. However, an abnormal compensation (so-called "overcompensation") for a pixel point with overlarge brightness difference may occur when the optical compensation method is applied to the pixel point, resulting in decrease in the compensation accuracy.

The inventors of the present disclosure have found that a main cause resulting in the problem is as follows: the CCD is a planar charge-coupled element, which converts an optical signal into an electrical signal, then converts the electrical signal into a digital signal and outputs the digital signal, and a magnitude of the output signal depends on an exposure time. The longer the exposure time is, the larger the output signal is. However, the exposure time of the CCD to each of all the pixel points in the entire display screen is constant. Therefore, there is insufficient exposure for the pixel points with overlarge brightness difference, and accordingly the signal captured for the pixel point is too small and the overcompensation may occur.

Due to the existence of the overcompensation, the existing compensation method may only compensate the pixel points with brightness difference within a certain range, leading to a limited compensation range and failing to realize an effective compensation for the pixel points with larger brightness difference, and the overall compensation effect is not ideal.

Figure 1:
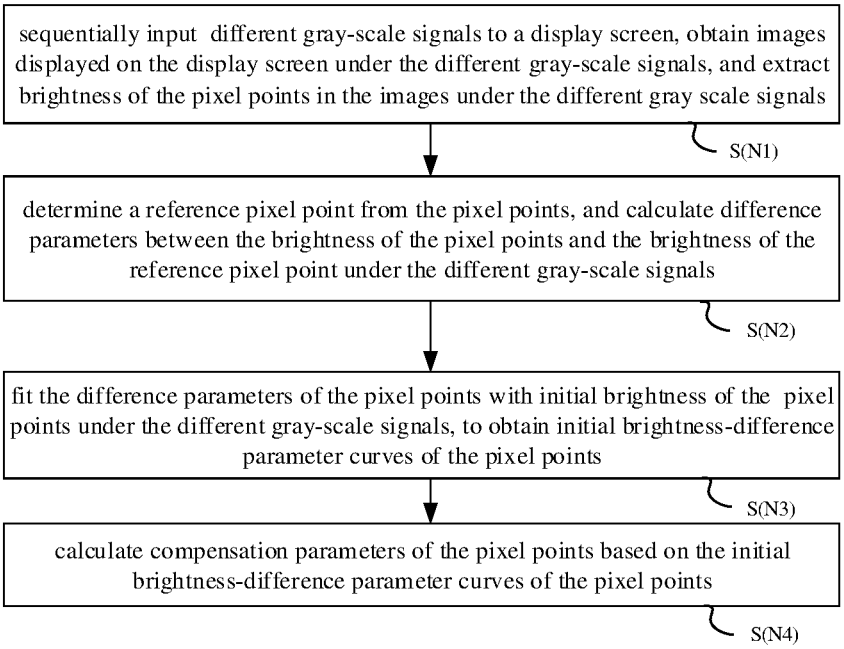
FIG. 1 is a flow chart illustrating steps of each measurement process in a compensation method provided by an embodiment of the present disclosure.

Based on the above, a brightness compensation method for pixel point is provided by an embodiment of the present disclosure. FIG. 1 is a flow chart illustrating steps of each measurement process in a compensation method provided by an embodiment of the present disclosure. As shown in FIG. 1, in some embodiments, the compensation method includes measurement processes of N times, N≥2. Each measurement process includes the following steps S(N1) to S(N4).

In step S(N1), different gray-scale signals are input sequentially to a display screen, images displayed on the display screen are obtained under the different gray-scale signals, and brightness of the pixel points under the different gray-scale signals is extracted therefrom.

In an embodiment, it is assumed that the number of the different gray-scale signals ($G_1$, $G_2$, . . . , $G_M$) input sequentially to the display screen during each measurement process is M, M≥2, in the above step S(N1). First, a first gray-scale signal $G_1$ is input to the display screen, such that all the pixel points of the display screen display at the same gray level, and a first image of the display screen is photographed by a photographing device such as CCDs to obtain the first image. The input signal is switched from the first gray-scale signal $G_1$ to a second gray-scale signal $G_2$, and a second image of the display screen is photographed under the second gray-level signal $G_2$. In this way, the different gray-scale signals are input sequentially and corresponding images are obtained until an $M^{th}$ gray-scale signal $G_M$ is input, and an $M^{th}$ image of the display screen is captured under the $M^{th}$ gray-level signal $G_M$.

It is assumed that, the number of the pixel points ($P_1$, $P_2$, . . . , $P_D$) included in the display screen is D, and the brightness $\{L_{1,1}, L_{2,1}, \ldots L_{D,1}\}$ of the pixel points $P_1$ to $P_D$ are extracted from the first image, the brightness $\{L_{1,2}, L_{2,2}, \ldots, L_{D,2}\}$ of the pixel points $P_1$ to $P_D$ is extracted from the second image, . . . , the brightness $\{L_{1,M}, L_{2,M}, \ldots, L_{D,M}\}$ of the pixel points $P_1$ to $P_D$ is extracted from the $M^{th}$ image, and in this way, the brightness of the pixel points is extracted from each of the captured images. That is, the brightness of the pixel point $P_1$ under the first to $M^{th}$ gray-scale signals $G_1$ to $G_M$ are $\{L_{1,1}, L_{1,2}, \ldots, L_{1,M}\}$, respectively; the brightness of the pixel point $P_2$ under the first to $M^{th}$ gray-level signals $G_1$ to $G_M$ are $\{L_{2,1}, L^{2,2}, \ldots, L_{2,M}\}$, respectively; . . . ; the brightness of the pixel point $P_D$ under the first to $M^{th}$ gray-scale signals $G_1$ to $G_M$ are $\{L_{D,1}, L_{D,2}, \ldots, L_{D,M}\}$, respectively.

It should be noted that, the number M of the different gray-scale signals input to the display screen during each measurement process may be selected according to the actual requirements. The number M is larger, the more data may be used to obtain compensation parameters, and thus the obtained compensation parameters are more accurate, leading to a better compensation effect. The number M is smaller, the calculation amount for obtaining the compensation parameter is smaller, and thus the calculation process is simpler and faster. For example, the number M may be one of 2 to 8, and in one example, the number M may be 6.

In step S(N2), a reference pixel point is determined from the pixel points included in the display screen, and difference parameters between the brightness of the pixel points and the brightness of the reference pixel point under the respective different gray-scale signals are calculated.

Figure 2:
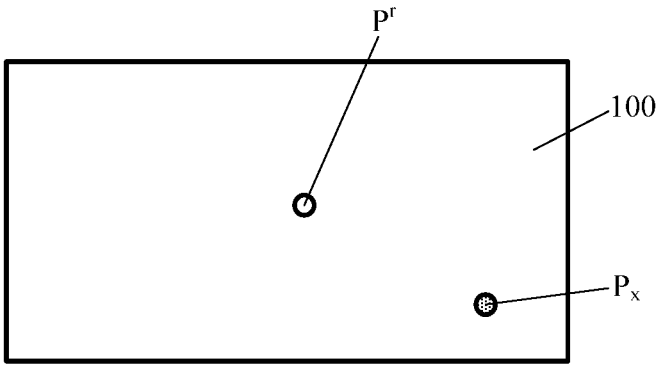
FIG. 2 is a schematic diagram of pixel points in a compensation method provided by an embodiment of the present disclosure.

FIG. 2 is a schematic diagram of pixel points in a compensation method provided by an embodiment of the present disclosure. In the above step S(N2), as shown in FIG. 2, any pixel point $P_x$ (x=1 to D) of all the pixel points included in the display screen may be select as a reference pixel point $P^r$. That is, the reference pixel point $P^r$ is one of all the pixel points $P_1$ to $P_D$. For example, the pixel point at a center of the display screen may be selected as the reference pixel point $P^r$. The brightness of all the pixel points under the different gray-scale signals $G_1$ to $G_M$ has been acquired in the step S(N1), and thus the brightness of the reference pixel point $P^r$ under the different gray-scale signals $G_1$ to $G_M$ are determined as $\{L_1^r, L_2^r, \ldots, L_M^r\}$.

In this step, the difference parameter between the brightness of a pixel point and the brightness of the reference pixel point under a certain gray-level signal may be defined as a reciprocal of a ratio of the two brightness values, and the difference parameter of each of the pixel points is calculated according to the following formula (1):

$$L_j^r = Q_{x,j} * L_{x,j} \tag{1}$$

where, j=1 to M; x=1 to D; $L_j^r$ is the brightness of the reference pixel point $P^r$ under a $(j)^{th}$ gray-level signal; $L_{x,j}$ is the brightness of an $(x)^{th}$ pixel point $P_x$ under the $(j)^{th}$ gray-scale signal; $Q_{x,j}$ is the difference parameter between the brightness of the $(x)^{th}$ pixel point $P_x$ under the $(j)^{th}$ gray-scale signal and the brightness of the reference pixel point $P_r$ under the $(j)^{th}$ gray-scale signal.

From the above formula (1), the difference parameters of the pixel point $P_1$ under the first to $M^{th}$ gray-scale signals $G_1$ to $G_M$ are $\{Q_{1,1}, Q_{1,2}, \ldots, Q_{1,M}\}$, the difference parameters of the pixel point $P_2$ under the first to $M^{th}$ gray-scale signals $G_1$ to $G_M$ are $\{Q_{2,1}, Q_{2,2}, \ldots, Q_{2,M}\}$, . . . , the difference parameters of the pixel point $P_D$ under the first to $M^{th}$ gray-scale signals $G_1$ to $G_M$ are $\{Q_{D,1}, Q_{D,2}, \ldots, Q_{D,M}\}$, and there are total D groups of difference parameters.

It should be noted that, since the reference pixel point $P^r$ is one of the pixel points $P_1$ to $P_D$, according to the above formula (1), the difference parameter between the reference pixel point $P^r$ and itself under a gray-level signal is 1, and among the above D groups of difference parameters, the difference parameters in a group of difference parameters (that is, the difference parameters corresponding to the reference pixel point $P^r$) are all 1.

In step S(N3), as for each of the pixel points, the difference parameters are fitted with the initial brightness of the pixel point under the different gray-scale signals to obtain an initial brightness-difference parameter curve of the pixel point.

It should be noted that, in the above step S(N3), the initial brightness of the pixel point refers to the brightness of the pixel point acquired in a first measurement process under the different gray-scale signals. The initial brightness of the pixel point $P_1$ under the first to $M^{th}$ gray-scale signals $G_1$ to $G_M$ may be expressed as $\{L_{1,1}^0, L_{1,2}^0, \ldots, L_{1,M}^0\}$, and the initial brightness of the pixel point $P_2$ under the first to $M^{th}$ gray-scale signals $G_1$ to $G_M$ may be expressed as $\{L_{2,1}^0, L_{2,2}^0, \ldots, L_{2,M}^0\}$, . . . , the initial brightness of the pixel point $P_D$ under the first to $M^{th}$ gray-level signals $G_1$ to $G_M$ may be expressed as $\{L_{D,1}^0, L_{D,2}^0, \ldots, L_{D,M}^0\}$.

Figure 3:
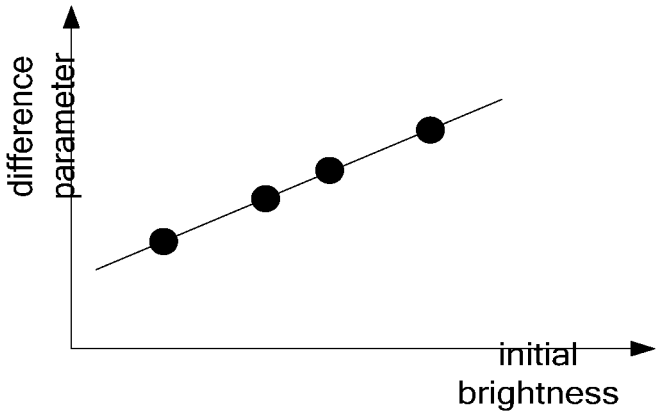
FIG. 3 is a schematic diagram of an initial brightness-difference parameter curve obtained by fitting.

In the above step S(N3), the difference parameters are fitted with the initial brightness of the pixel point under the different gray-scale signals by using a linear function, a quadratic function, a higher-order function, an exponential function, or the like. The linear function is taken as an example. The initial brightness-difference parameter curve fitted by the linear function is a straight line. FIG. 3 is a schematic diagram of the fitted initial brightness-difference parameter curve. As shown in FIG. 3, in the initial brightness-difference parameter curve, the horizontal axis represents the initial brightness, and the vertical axis represents the difference parameter. The initial brightness and the difference parameter of the pixel point under the first to M gray-level signals $G_1$ to $G_M$ are known. That is, M points are known, and a straight line may be obtained by fitting the M points. With the above fitting process, D initial brightness-difference parameter curves corresponding to the pixel points $P_1$ to $P_D$ respectively may be obtained.

It should be noted that, the fitting process is a process of predicting unknown points based on known points. The initial brightness before fitting refers to the brightness of the pixel point acquired in the first measurement process under the different gray-scale signals, and the pixel points are still uncompensated in the first measurement process. The initial brightness after fitting may be any value on the horizontal axis, and the initial brightness has a broader meaning at this time, and may mean the brightness of the pixel point without any compensation under the different gray-scale signals.

In step S(N4), the compensation parameters of the pixel points are calculated according to the initial brightness-difference parameter curves of the pixel points, respectively.

The above step S(N4) may specifically adopt the following process.

First, the initial brightness-difference parameter curve of each of the pixel points is expressed by the following formula (2):

$$Q_x = K_x' * L_x^0 + K_x'' \tag{2}$$

where $Q_x$ is the difference parameter between the brightness of the $(x)^{th}$ pixel point and the brightness of the reference pixel point under a gray-level signal; $L_x^0$ is the initial brightness of the $(x)^{th}$ pixel point under the gray-level signal; $K_x'$ and $K_x''$ are coefficients.

Since the initial brightness-difference parameter curve of the pixel point is a straight line, the initial brightness-difference parameter curve of the pixel point may be expressed by the above-described linear function. For example, the initial brightness-difference parameter curve of the first pixel point $P_1$ is expressed as: $Q_1 = K_1' * L_1^0 + K_1''$, the initial brightness-difference parameter curve of the second pixel point $P_2$ is expressed as: $Q_2 = K_2' * L_2^0 + K_2''$, . . . , the initial brightness-difference parameter curve of the $D^{th}$ pixel point $P_D$ is expressed as: $Q_D = K_D' * L_D^0 + K_D''$.

Then, a value of $K_x'$ as a first compensation parameter of the $(x)^{th}$ pixel point and a value of $K_x''$ as a second compensation parameter of the $(x)^{th}$ pixel point are calculated. Since the initial brightness-difference parameter curve of the pixel point has been obtained by fitting, the value of $K_x'$ is a slope of the initial brightness-difference parameter curve, and the value of $K_x''$ is a vertical intercept of the initial brightness-difference parameter curve. For example, the following parameters will obtain: a first compensation parameter $K_1'$ and a second compensation parameter $K_1''$ of the pixel point $P_1$, a first compensation parameter $K_2'$ and a second compensation parameter $K_2''$ of the pixel point $P_2$, . . . , a first compensation parameter $K_D'$ and a second compensation parameter $K_D''$ of the pixel point $P_D$. It should be noted that, the calculated first compensation parameter $K_x'$ and the second compensation parameter $K_x''$ of the pixel point are only the compensation parameters obtained during the current measurement process, and it should be clear that, the compensation parameters obtained during the respective measurement processes may not be the same.

In the present embodiment, the corresponding compensation parameters may be obtained by performing the above steps S(N1) to S(N4) during each measurement process. For example, during an $(i)^{th}$ measurement process, i=2 to N, the images displayed on the display screen under the different gray-scale signals are images obtained by compensating the initial brightness of the pixel points under the different gray-scale signals based on the compensation parameters obtained during the $(i-1)^{th}$ measurement process. That is to say, during the first measurement process, the first to $M^{th}$ images on the display screen obtained by photographing under the first to M gray-scale signals $G_1$ to $G_M$ are uncompensated images; and during each of the second to $(N)^{th}$ measurement processes, the first to $M^{th}$ images on the display screen obtained by photographing under the gray-scale signals $G_1$ to $G_M$ are images compensated by the compensation parameters obtained during the previous measurement process, such that during each of the second to $N^{th}$ measurement processes, the brightness of the pixel points, on which the calculation of compensation parameters is based during the measurement process, is the brightness obtained after compensating the brightness of the pixel points using the compensation parameters obtained from the previous measurement process.

In the above solution, during the $(i)^{th}$ measurement process (i=2 to N), the initial brightness of the pixel points under the different gray-scale signals is compensated based on the compensation parameters obtained during the $(i-1)^{th}$ measurement process, to make the display screen display compensated images, which may be implemented as follows.

First, the compensated brightness of the pixel point under the different gray-scale signals is calculated according to the following formula (3):

$$L_{x,j} = K_x' * (L_{x,j}^0)^2 + K_x'' * L_{x,j}^0 \tag{3}$$

where $L_{x,j}$ is the compensated brightness of the $(x)^{th}$ pixel point under the $(j)^{th}$ gray-scale signal; $L_{x,j}^0$ is the initial brightness of the $(x)^{th}$ pixel point under the $(j)^{th}$ gray-scale signal; and $K_x'$ and $K_x''$ are the compensation parameters obtained during the $(i-1)^{th}$ measurement process.

The "compensated brightness" refers to the brightness obtained after compensating the initial brightness (that is, the brightness of the $(x)^{th}$ pixel point under a certain gray-scale signal during the first measurement process, that also is, the brightness of the $(x)^{th}$ pixel at the certain gray-scale signal without any compensation) of the pixel point using the compensation parameters obtained from the previous measurement process. Since the compensated brightness $L_{x,j}$ of the $(x)^{th}$ pixel point under the $(j)^{th}$ gray-scale signal should be equal to the product of the difference parameter $Q_{x,j}$, between the brightness of the $(x)^{th}$ pixel point under the $(j)^{th}$ gray-scale signal and the brightness of the reference pixel point under the $(j)^{th}$ gray-scale signal, and the initial brightness $L_{x,j}^0$ of the $(x)^{th}$ pixel point under the $(j)^{th}$ gray-scale signal, i.e., $L_{x,j}=Q_{x,j}*L_{x,j}^0$. According to the formula (2): $Q_x=K_x'*L_x^0+K_x''$, a formula $Q_{x,j}=K_x'*L_{x,j}^0+K_x''$ is obtained, where $K_x'$ and $K_x''$ are compensation parameters obtained during the $(i-1)^{th}$ measurement process, therefore, $L_{x,j}=Q_{x,j}*L_{x,j}^0=(K_x'*L_{x,j}^0+K_x'')*L_{x,j}^0=K_x'*(L_{x,j}'')^2+K_x''*L_{x,j}^0$.

Then, compensated different gray-scale signals corresponding to the compensated brightness of the pixel points under the different gray-scale signals are obtained according to a correspondence between a gray-level signal and brightness. There is a certain correspondence between the gray-level signal input to the pixel points and the brightness for the display screen. The gray-level signals corresponding to the compensated brightness of the pixel points may be determined according to the correspondence. The gray-scale signals are called the compensated gray-scale signal.

Then, when different gray-scale signals $G_1$ to $G_M$ are sequentially input to the display screen, the input different gray-level signals $G_1$ to $G_M$ are respectively converted into corresponding compensated gray-scale signals for the pixel points, such that the pixel points display with the corresponding compensated brightness.

It should be noted that, the above measurement processes are performed on the production line before the display screen leaves the factory. The compensation parameters are obtained by at least two measurement processes, and then are stored in a driving controller of the display screen, in order to compensate the brightness of the pixel points by the driving controller of the display screen using the compensation parameters obtained during the last measurement process when actual images are displayed by the display screen.

Figure 4:
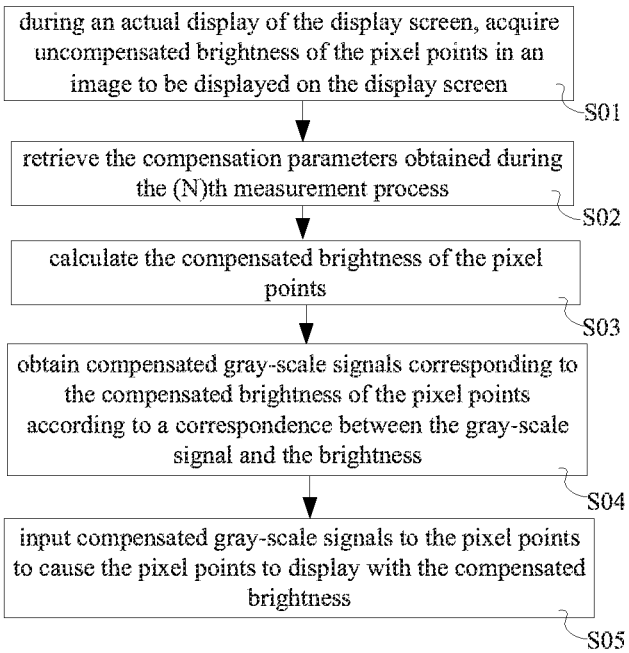
FIG. 4 is a flowchart of a compensation process during an actual display in a compensation method provided by an embodiment of the present disclosure.

FIG. 4 is a flowchart of a compensation process during an actual display in a compensation method provided by an embodiment of the present disclosure. Therefore, as shown in FIG. 4, the brightness compensation method for pixel point in this embodiment may further include the following steps S01 to S05.

In step S01, during the actual display of the display screen, uncompensated brightness of the pixel points in the images to be displayed on the display screen is acquired.

In step S02, the compensation parameters obtained during the $(N)^{th}$ measurement process are retrieved.

In step S03, compensated brightness of the pixel points is calculated according to the following formula (4):

$$L_x=K_{x,N}'*(L_x^0)^2+K_{x,N}''*L_x^0 \quad (4)$$

Where $L_x$ is the compensated brightness of the $(x)^{th}$ pixel point; $L_x^0$ is the uncompensated brightness of the $(x)^{th}$ pixel point; $K_{x,N}'$ is the first compensation parameter of the $(x)^{th}$ pixel point to be compensated obtained during the $(N)^{th}$ measurement process; $K_{x,N}''$ is the second compensation parameter of the $(x)^{th}$ pixel point to be compensated during the $(N)^{th}$ measurement process.

In step S04, compensated gray-scale signals corresponding to the compensated brightness of the pixel points are obtained according to the correspondence between the gray-scale signal and the brightness.

In step S05, compensated gray-scale signals are respectively input to the pixel points to cause the pixel points to display with compensated brightness.

By performing the steps S01 to S05, the effective brightness compensation for the pixel points in the image to be displayed is realized by using the compensation parameters obtained during the $(N)^{th}$ measurement process.

In this embodiment, after the compensation parameters are obtained at the end of each measurement process, the compensation parameters are stored in a drive controller of the display screen, such that the drive controller can directly retrieve the stored compensation parameters during the last measurement process to compensate the brightness of the pixel points during a next measurement process.

In addition, since the compensation for the pixel points only needs to be based on the compensation parameters obtained during the last (e.g., the $(N)^{th}$) measurement process when an actual display of the display screen, new compensation parameters to be stored may directly overlay the compensation parameters stored during the last measurement process when the compensation parameters are to be stored. That is, the compensation parameters obtained during the $(i)^{th}$ measurement process overlay the compensation parameters obtained during the $(i-1)^h$ measurement process, thereby saving a storage space in the drive controller and improving a calculating speed.

In the above brightness compensation method for pixel point in the embodiments, at least two measurement processes are included. During each measurement process, different gray-scale signals are input, difference parameters between the brightness of the pixel points and the brightness of the reference pixel point under different gray-scale signals are calculated, and the initial brightness-difference parameter curves are obtained by fitting, such that the compensation parameters of the current measurement process may be obtained. Moreover, the images displayed on the display screen under different gray-scale signals during the current measurement process are images obtained by compensating the initial brightness of the pixel points under different gray-scale signals based on the compensation parameters obtained during the last measurement process.

Therefore, by performing the iteration, the brightness difference between the pixel points and the reference pixel point may be successively reduced, the obtained compensation parameters are successively refined, the compensation parameters obtained in the last measurement process have the highest accuracy, and accordingly, the brightness of the display screen is compensated to obtain a good compensation effect.

It can be seen that, for a pixel point with large brightness difference, the scheme includes at least two measurement processes. First, the compensation parameters of the pixel point with large brightness difference are extrapolated by the fitting in the first measurement process, that is, the compensation range is expanded, and based on this, the pixel point with large brightness difference is compensated. After the compensation effect is improved, that is, the brightness difference between the reference pixel point and the pixel points is initially reduced, then at least one measurement process is performed on the basis of the compensation, and compensation parameters are obtained by interpolation. The pixel point with large brightness difference is further compensated, and the brightness difference between the reference pixel point and the pixel point is further reduced, thereby improving the compensation effect of the pixel point with large brightness difference and achieving brightness uniformity of the full display screen.

Figure 5:
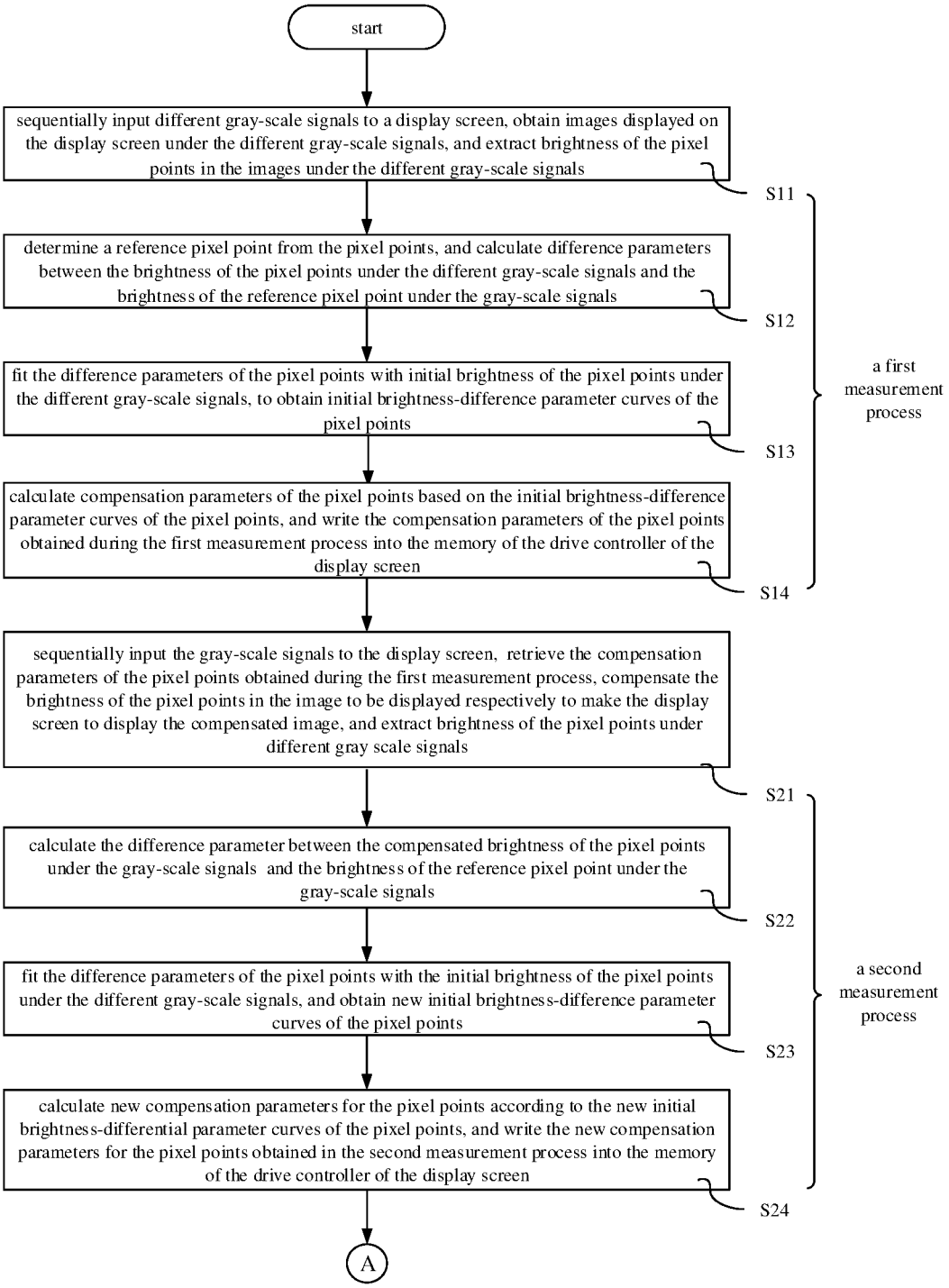
FIG. 5 is a flowchart of a compensation method provided by an embodiment of the present disclosure.
Figure 5:
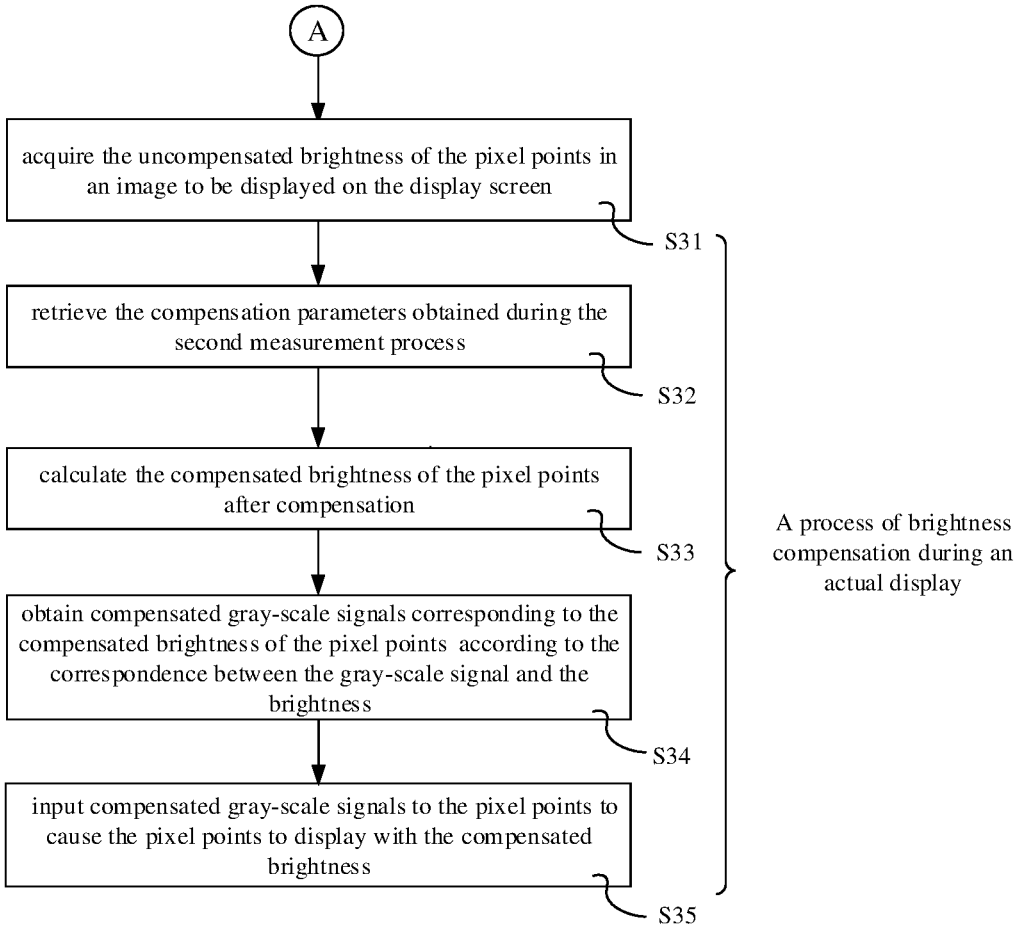

FIG. 5 is a flowchart of a brightness compensation method provided by an embodiment of the present disclosure. The brightness compensation method for pixel point provided by the embodiment is exemplarily described below with reference to FIG. 5. As shown in FIG. 5, it is assumed that, the compensation method includes two measurement processes (i.e., N=2), two different gray-scale signals $G_1$,$G_2$ are input to the display screen during each measurement process, and there are a total of 100 pixel points $P_1$ to $P_{100}$ in the display screen. The compensation method includes the following steps S11 to S35, as shown in FIG. 5.

In step S11, the gray-scale signals $G_1$, $G_2$ are sequentially input to the display screen, the images displayed on the display screen under the gray-scale signals $G_1$, $G_2$ are obtained, and the brightness of the pixel points under the gray-scale signals $G_1$, $G_2$ is extracted therefrom.

The brightness of the pixel point $P_1$ under the gray-scale signals $G_1$, $G_2$ is $\{L_{1,1}, L_{1,2}\}$.

The brightness of the pixel point $P_2$ under the gray-scale signals G1, G2 is $\{L_{2,1}, L_{2,2}\}$;

. . .

The brightness of the pixel point $P_{100}$ under the gray-scale signals G1, G2 is $\{L_{100,1}, L_{100,2}\}$.

In step S12, the reference pixel point $P^r$ is determined from the pixel points, and the difference parameter between the brightness L of the pixel points under the gray-scale signals $G_1$, $G_2$ and the brightness U of the reference pixel point $P^r$ under the gray-scale signals $G_1$, $G_2$ is calculated.

For the pixel point $P_1$, $Q_{1,1}$ and $Q_{1,2}$ may be obtained by calculation according to $L_1^r=Q_{1,1}*L_{1,1}$ and $L_2^r=Q_{1,2}*L_{1,2}$.

For the pixel point $P_2$, $Q_{2,1}$ and $Q_{2,2}$ may be obtained by calculation according to $L_1^r=Q_{2,1}*L_{2,1}$ and $L_2^r=Q_{2,2}*L_{2,2}$.

. . .

For the pixel point $P_{100}$, $Q_{100,1}$ and $Q_{100,2}$ may obtained by calculation according to $L_1^r=Q_{100,1}*L_{100,1}$ and $L_2^r=Q_{100,2}*L_{100,2}$.

Where, the difference parameter between the reference pixel point $P^r$ and itself is 1 under a same gray-scale signal.

In step S13, the difference parameters of the pixel points are fitted with the initial brightness of the corresponding pixel points under different gray-scale signals to obtain initial brightness-difference parameter curves of the pixel points.

For the pixel point $P_1$, in a case that two points $(L_{1,1}, Q_{1,1})$ and $(L_{1,2}, Q_{1,2})$ a known, an initial brightness-difference parameter curve 1 is obtained by performing linear function fitting, which is expressed as: $Q_1=K_1'*L_1+K_1''$.

For the pixel point $P_2$, in a case that two points $(L_{2,1}, Q_{2,1})$ and $(L_{2,2}, Q_{2,2})$ are known, an initial brightness-difference parameter curve 2 is obtained by performing linear function fitting, which is expressed as: $Q_2=K_2'*L_2+K_2''$.

. . .

For the pixel point $P_{100}$, in a case that two points $(L_{100,1}, Q_{100,1})$ and $(L_{100,2}, Q_{100,2})$ are known, an initial brightness-difference parameter curve 100 is obtained by performing linear function fitting, which is expressed as: $Q_{100}=K_2'*L_2+K_2''$.

In step S14, the compensation parameters of the pixel points are calculated according to the initial brightness-difference parameter curves 1 to 100 of the pixel points, and the compensation parameters of the pixel points obtained during the first measurement process are written into a memory of the drive controller of the display screen.

For the pixel point $P_1$, a slope and a vertical intercept of the initial brightness-difference parameter curve 1 respectively as its first compensation parameter $K_1'$ and second compensation parameter $K_1''$ are calculated.

For the pixel point $P_2$, a slope and a vertical intercept of the initial brightness-difference parameter curve 2 respectively as its first compensation parameter $K_2'$ and second compensation parameter $K_2''$ are calculated.

. . .

For pixel $P_{100}$, a slope and a vertical intercept of the initial brightness-difference parameter curve 100 respectively as its first compensation parameter $K_{100}'$ and second compensation parameter $K_{100}''$ are calculated.

The above steps S11 to S14 belong to the first measurement process. In the first measurement process, the compensation range may be expanded by fitting, even for the pixel points with large brightness difference, preliminary brightness compensation may be performed according to the first and second compensation parameter, i.e., the compensated brightness may be obtained by extrapolation, thereby reducing the brightness difference from the reference pixel point.

In step S21, the gray-scale signals $G_1$ and $G_2$ are sequentially input to the display screen, the compensation parameters of the pixel points obtained during the first measurement process are retrieved, and the brightness of the pixel points in the image to be displayed is compensated respectively to make the display screen to display the compensated image. The compensated images displayed on the display screen under the gray-scale signals $G_1$, $G_2$ are photographed, and the brightness of the pixel points under the gray-scale signals $G_1$, $G_2$ is extracted from the compensated images.

The brightness of the pixel point $P_1$ under the gray-scale signals $G_1$, $G_2$ is $\{L_{1,1}', L_{1,2}'\}$. The brightness of the pixel point $P_2$ under the gray-scale signals $G_1$, $G_2$ is $\{L_{2,1}', L_{2,2}'\}$.

The brightness of the pixel point $P_{100}$ under the gray-scale signals $G_1$, $G_2$ is $\{L_{100,1}', L_{100,2}'\}$.

Since the difference parameter between the reference pixel point $P^r$ and itself is 1 under a same gray-scale signal, it is not necessary to compensate the brightness of the reference pixel point $P^r$, and the brightness of the reference pixel point $P^r$ under the gray-scale signals $G_1$, $G_2$ is still $L_1^r$, $L_2^r$ respectively.

In step S22, the difference parameter between the compensated brightness L' of the pixel points under the gray-scale signals $G_1$, $G_2$ and the brightness $L^r$ of the reference pixel point $P^r$ under the gray-scale signals $G_1$, $G_2$ is calculated.

For the pixel point $P_1$, $Q_{1,1}'$ and $Q_{1,2}'$ may be calculated according to $L_1^r=Q_{1,1}'*L_{1,1}'$ and $L_2^r=Q_{1,2}'*L_{1,2}'$.

For the pixel point $P_2$, $Q_{2,1}'$ and $Q_{2,2}'$ may be calculated according to $L_1^r=Q_{2,1}'*L_{2,1}'$ and $L_2^r=Q_{2,2}'*L_{2,2}'$.

. . .

For the pixel point $P_{100}$, $Q_{100,1}'$ and $Q_{100,2}'$ may be calculated according to $L_1^r=Q_{100,1}'*L_{100,1}'$ and $L_2^r=Q_{100,2}'*L_{100,2}'$.

In step S23, the difference parameters of the pixel points are fitted with the initial brightness of the corresponding pixel points under different gray-scale signals, and new initial brightness-difference parameter curves of the pixel points are obtained.

For the pixel point $P_1$, in a case that two points $(L_{1,1}, Q_{1,1}')$ and $(L_{1,2}, Q_{1,2}')$ a known, an initial brightness-difference parameter curve 1' is obtained by performing linear function fitting, which is expressed as: $Q_1'=K_1'*L_1^0+K_1''$.

For the pixel point $P_2$, in a case that two points ($L_{2,1}$, $Q_{2,1}'$) and ($L_{2,2}$, $Q_{2,2}'$) a known, an initial brightness-difference parameter curve 2' is obtained by performing linear function fitting, which is expressed as: $Q_2'=K_2'*L_2^0+K_2''$.

. . .

For the pixel point $P_{100}$, in a case that two points ($L_{100,1}$, $Q_{100,1}'$) and ($L_{100,2}$, $Q_{100,2}'$) are known, an initial brightness-difference parameter curve 100' is obtained by performing linear function fitting, which is expressed as: $Q_{100}'=K_{100}'*L_{100}^0+K_{100}''$.

In step S24, new compensation parameters for the pixel points are calculated according to the new initial brightness-difference parameter curves 1' to 100' of the pixel points, and the new compensation parameters for the pixel points are written into the memory of the drive controller of the display screen to overlay the compensation parameters for the pixel points obtained in the first measurement process.

For the pixel point $P_1$, the slope and the vertical intercept of the initial brightness-difference parameter curve 1' respectively as its first compensation parameter $K_1'$ and as its second compensation parameter $K_1''$ are calculated.

For the pixel point $P_2$, the slope and the vertical intercept of the initial brightness-difference parameter curve 2' respectively as its first compensation parameter $K_2'$ and as its second compensation parameter $K_2''$ are calculated.

. . .

For the pixel point $P_{100}$, the slope and the vertical intercept of the initial brightness-difference parameter curve 100' respectively as its first compensation parameter $K_{100}'$ and as its second compensation parameter $K_{100}''$ are calculated.

The above steps S21 to S24 belong to the second measurement process. In the second measurement process, the images, which the compensation parameters are calculated based on, are the images obtained by compensating the images to be displayed using the compensation parameters obtained during the first measurement process, such that accuracy of the compensation parameters is realized by interpolation and when the compensation parameters obtained during the second measurement process are used to compensate the brightness of the pixel point with different brightness difference, the brightness difference between the reference pixel point and the pixel point may be further reduced, and the compensation effect and accuracy may be improved.

In step S31, during the actual display of the display screen, the uncompensated brightness $L^0$ of the pixel points in the image to be displayed on the display screen is acquired.

The uncompensated brightness of the pixel point $P_1$ is $L_1^0$.

The uncompensated brightness of the pixel point $P_2$ is $L_2^0$.

. . .

The uncompensated brightness of the pixel point $P_{100}$ is $L_{100}^0$.

In step S32, the compensation parameters obtained during the second measurement process are retrieved.

The first compensation parameter of the pixel point $P_1$ obtained during the second measurement process is $K_{1,2}'$, and the second compensation parameter of the pixel point $P_1$ obtained during the second measurement process is $K_{1,2}''$.

The first compensation parameter of the pixel point $P_2$ obtained during the second measurement process is $K_{2,2}'$, and the second compensation parameter of the pixel point $P_1$ obtained during the second measurement process is $K_{100,2}''$.

. . .

The first compensation parameter of the pixel point $P_{100}$ obtained during the second measurement process is $K_{100,2}'$, and the second compensation parameter of the pixel point $P_1$ obtained during the second measurement process is $K_{100,2}''$.

In step S33, the compensated brightness L the pixel points after compensation is calculated.

According to $L_1=K_{1,2}'*(L_1^0)^2+K_{1,2}''*L_1^0$, the calculated brightness $L_1$ of the pixel point $P_1$ is calculated.

According to $L_2=K_{2,2}'*(L_2^0)^2+K_{2,2}''*L_2^0$, the calculated brightness $L_2$ of the pixel point $P_2$ is calculated.

. . .

According to $L_{100}=K_{100,2}'*(L_{100}^0)^2+K_{100,2}''*L_{100}^0$, the compensated brightness $L_{100}$ of the pixel point $P_{100}$ is calculated.

In step S34, compensated gray-scale signals corresponding to the compensated brightness of the pixel points are obtained according to the correspondence between the gray-scale signals and the brightness.

In step S35, the compensated gray-scale signals are respectively input to the pixel points to cause the pixel points to display with corresponding compensated brightness.

The above steps S31 to S35 belong to the process of brightness compensation during an actual display of the display screen.

Figure 6:
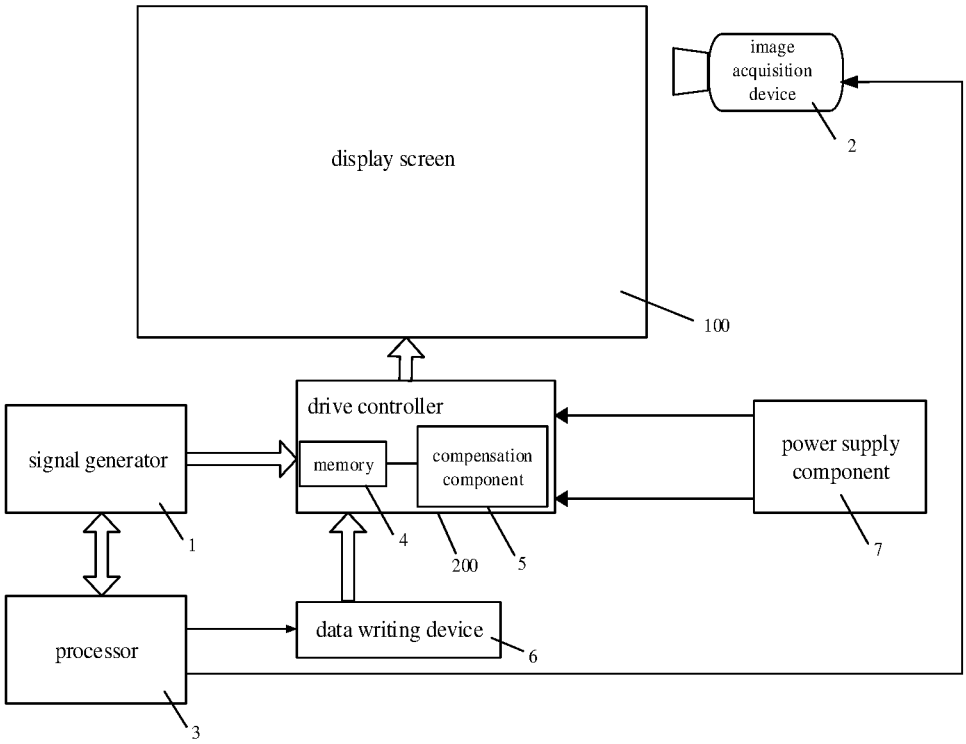
FIG. 6 is a diagram of a basic structure of a compensation apparatus provided by an embodiment of the present disclosure.

A brightness compensation apparatus for pixel point is further provided in an embodiment of the present disclosure. FIG. 6 is a diagram of a basic structure of a compensation apparatus provided by an embodiment of the present disclosure. As shown in FIG. 6, the brightness compensation apparatus for pixel point may include the following components: a signal generator 1, an image acquisition device 2, a processor 3, a memory 4, and a compensation component 5.

The signal generator 1 may be configured to generate different gray-scale signals and sequentially output the generated different gray-scale signals to a display screen 100.

The image acquisition device 2 may be configured to acquire the displayed images of the display screen 100 under different gray-scale signals during each measurement process.

The processor 3 may be coupled to the image acquisition device 2 and configured to extract the brightness of the pixel points under different gray-scale signals from the acquired images, and based on the brightness, calculate the compensation parameters of the pixel points during each measurement process. The processor 3 may also be coupled to the signal generator 1 and configured to control the signal generator 1 to generate the different gray-scale signals, and the signal generator 1 may also feed a status illustrating its own task execution back to the processor 3.

The memory 4 may be coupled to the processor 3, and configured to store the compensation parameters obtained during the current measurement process after the measurement process ends.

The compensation component 5 may be coupled between the signal generator 1 and the display screen 100, and the compensation component 5 may also be coupled to the memory 4. The compensation component 5 is configured to retrieve compensation parameters obtained during the previous measurement process from the memory and hereby to compensate the initial brightness of the pixel points under the different gray-scale signals during the current measurement process, such that the display screen 100 displays a compensated image. The compensation component 5 may also be configured to retrieve compensation parameters obtained during the last measurement process from the memory and hereby to compensate the brightness of the pixel points intended to display during an actual display of the display screen.

It should be noted that, the initial brightness refers to the brightness of the pixel points acquired in the first measurement process under different gray-scale signals.

The compensation parameters required for the brightness compensation for the pixel points may be accurately calculated by the brightness compensation apparatus for the pixel points, and the compensation parameters may be used by the brightness compensation apparatus for pixel points to compensate the brightness of the pixel points on the display screen 100. The brightness compensation apparatus may also perform an effective compensation for the pixel points with large brightness difference, therefore eliminating the overcompensation and achieving a good compensation effect and improving the brightness uniformity of the display screen.

Referring again to FIG. 6, in some embodiments, the brightness compensation apparatus for pixel points may further include a data writing device 6 coupled between the processor 3 and the memory 4, and configured to write the compensation parameter obtained during each measurement process to the memory 4.

In some embodiments, as shown in FIG. 6, the memory 4 and the compensation component 5 may be integrated in a drive controller 200 of the display screen 100 to increase the integration degree of the display apparatus. The memory 4 may be a non-volatile memory, such as a read only memory (ROM), a flash memory, or the like. The compensation component 5 and the data writing device 6 may be implemented as an integrated circuit (IC), an application specific integrated circuit or the like.

In some embodiments, as shown in FIG. 6, the brightness compensation apparatus for pixel point may further include a power supply component 7, which may be coupled to the drive controller 200, and configured to supply power to the drive controller 200, thereby securing a normal operation of the memory 4 and the compensation component 5.

In addition, in the brightness compensation apparatus for pixel point of the embodiments of the present disclosure, the image acquisition device 2 may be a photographing device, such as CCDs, and the photographing device may acquire an image displayed on the display screen 100 by photographing. The processor 3 may be a microprocessor, a microcontroller, an application specific integrated circuit, a single core processor, a multi-core processor, or the like.

A computer product including one or more processors is provided by an embodiment of the present disclosure. The one or more processors are configured to execute computer instructions to perform one or more steps of the brightness compensation method for pixel point as described in embodiments of the present disclosure. The beneficial effects that the computer product may achieve are the same as those of the brightness compensation method for pixel point described in the embodiments of the present disclosure, and are not described herein again.

A computer readable storage medium on which computer executable instructions are stored is provided by an embodiment of the present disclosure. When the computer executable instructions are executed by one or more processors, the computer executable instructions cause the one or more processors to perform one or more steps of the brightness compensation method for pixel point. The beneficial effects that the computer readable storage medium may achieve are the same as those of the brightness compensation method for pixel point described in the embodiments of the present disclosure, and are not described herein again. The computer readable storage medium may be a non-volatile storage medium such as a read only memory (ROM).

The above are only exemplary embodiments of the present disclosure, but the scope of protection of the present disclosure is not limited herein. Any change or substitution that is readily available to any person skilled in the art shall be covered by this disclosure. Therefore, the scope of protection of the present disclosure shall be defined by the scope of protection of the claims.

What is claimed is:

1. A brightness compensation apparatus for pixel point, comprising:

a signal generator configured to generate a plurality of gray-scale signals and sequentially output the plurality of gray-scale signals to a display screen;

an image acquisition device configured to acquire images displayed on the display screen under the plurality of gray-scale signals during each measurement process;

a processor coupled to the image acquisition device, and configured to extract brightness of the pixel points from the images under the plurality of gray-scale signals and to calculate compensation parameters of the pixel points based on the extracted brightness during each measurement process; and the processor further being coupled to the signal generator and configured to control the signal generator to generate the plurality of gray-scale signals;

a memory coupled to the processor and configured to store the compensation parameters obtained during a current measurement process at the end of the current measurement process;

a compensation component coupled between the signal generator and the display screen, wherein the compensation component is further coupled to the memory, configured to retrieve, during a measurement process, compensation parameters obtained during a previous measurement process from the memory and to compensate the initial brightness of the pixel points under the plurality of gray-scale signals based on the compensation parameters, such that the display screen displays compensated images, and wherein the initial brightness is the brightness of the pixel points under the plurality of gray-scale signals obtained during a first measurement process; and the compensation component is further configured to retrieve compensation parameters from the memory during a last measurement process and to compensate the brightness of the pixel points intended to display during an actual display of the display screen.

2. The brightness compensation apparatus for pixel point of claim 1, wherein the memory and the compensation component are integrated in a drive controller of the display screen.

3. A brightness compensation method for pixel point, the brightness compensation method comprising: when an $(i)^{th}$ measurement process is executed and $1 \leq i \leq N$ and N is an integer greater than 1, sequentially inputting a plurality of gray-level signals to a display screen, obtaining images displayed on the display screen under the plurality of gray-scale signals, and extracting brightness of pixel points in the images under the plurality of gray-scale signals;

determining a reference pixel point from the pixel points, and calculating difference parameters between the brightness of the pixel points and the brightness of the reference pixel point under the plurality of gray-scale signals;

fitting the difference parameters of the pixel points with initial brightness of the pixel points under the plurality of gray-level signals, respectively, to obtain initial brightness-difference parameter curves of the pixel points, wherein the initial brightness of the pixel points is obtained in a first measurement process under the plurality of gray-scale signals; and calculating compensation parameters of the pixel points based on the initial brightness-difference parameter curves of the pixel points, wherein during the $(i)^{th}$ measurement process, i=2 to N, images displayed on the display screen under the plurality of gray-level signals are obtained by compensating the initial brightness of the pixel points under the plurality of gray-level signals based on the compensation parameters obtained during an $(i-1)^{th}$ measurement process.

4. The brightness compensation method for pixel point of claim 3, wherein the calculating difference parameters between the brightness of the pixel points and the brightness of the reference pixel point under the plurality of gray-scale signals, comprises:

recording the number of the plurality of gray-scale signals, input sequentially to the display screen during each measurement process, when M is an integer greater than 1, and the number of the pixel points in the display screen being D, when D is an integer greater than 1;

calculating the difference parameters of each of the pixel points based on the following formula (1):

$$L_j^r = Q_{x,j} * L_{x,j} \quad (1)$$

wherein j=1 to M; x=1 to D; $L_j^r$ is a brightness of the reference pixel point under a $(j)^{th}$ gray-scale signal; $L_{x,j}$ is a brightness of an $(x)^{th}$ pixel point under the $(j)^{th}$ gray-scale signal; $Q_{x,j}$ is a difference parameter between the brightness of the $(x)^{th}$ pixel point and the brightness of the reference pixel point under the $(j)^{th}$ gray-scale signal.

5. The brightness compensation method for pixel point of claim 4, wherein the fitting the difference parameters of the pixel points with initial brightness of the pixel points under the plurality of gray-scale signals comprises fitting the difference parameters of the pixel points with initial brightness of the pixel points under the plurality of gray-scale signals comprises by linear function fitting; and the calculating compensation parameters of the pixel points based on the initial brightness-difference parameter curves of the pixel points comprises:

expressing the initial brightness-difference parameter curve of each of the pixel points by the following formula (2):

$$Q_x = K_x' * L_x^0 + K_x'' \quad (2)$$

wherein $Q_x$ is the difference parameter between the brightness of the $(x)^{th}$ pixel point and the brightness of the reference pixel point under a gray-scale signal; $L_x^0$ is the initial brightness of the $(x)^{th}$ pixel point under the gray-scale signal; and $K_x'$ and $K_x''$ are coefficients;

calculating a value of $K_x'$ as a first compensation parameter of the $(x)^{th}$ pixel point and a value of $K_x''$ as a second compensation parameter of the $(x)^{th}$ pixel point.

6. The brightness compensation method for pixel point of claim 4, wherein the compensating the initial brightness of the pixel points under the plurality of gray-scale signals comprises:

calculating compensated brightness of each of the pixel points under the plurality of gray-scale signals based on the following formula (3):

$$L_{x,j} = K_x' * (L_{x,j}^0) + K_x'' * L_{x,j}^0 \quad (3)$$

wherein $L_{x,j}$ is the compensated brightness of the $(x)^{th}$ pixel point under the $(j)^{th}$ gray-scale signal; $L_{x,j}^0$ is the initial brightness of the $(x)^{th}$ pixel point under the $(j)^{th}$ gray-scale signal; and $K_x'$ $K_x''$ are compensation parameters obtained in the $(i-1)^{th}$ measurement process;

obtaining compensated gray-scale signals of the pixel points corresponding to the compensated brightness under the plurality of gray-scale signals based on a correspondence between a gray-scale signal and a brightness; and converting multiple gray-scale signals, which are intended to be sequentially input to the display screen, into compensated gray-scale signals for the pixel points, such that the pixel points display with the compensated brightness, respectively.

7. The brightness compensation method for pixel point of claim 4, further comprising: during an actual display of the display screen, obtaining uncompensated brightness of the pixel points in an image to be displayed on the display screen;

retrieving the compensation parameters obtained during the $(N)^{th}$ measurement process;

calculating compensated brightness of each of the pixel points based on the following formula (4):

$$L_x = K_{x,N}' * (L_x^0)^2 + K_{x,N}'' * L_x^0 \quad (4)$$

wherein $L_x$ is the compensated brightness of the $(x)^{th}$ pixel point; $L_x^0$ is the uncompensated brightness of the $(x)^{th}$ pixel point; $K_{x,N}'$ is a first compensation parameter of the $(x)^{th}$ pixel point obtained during the $(N)^{th}$ measurement process; $K_{x,N}''$ is a second compensation parameter of the $(x)^{th}$ pixel obtained during the $(N)^{th}$ measurement process;

obtaining the compensated gray-scale signals of the pixel points corresponding to the compensated brightness based on the correspondence between the gray-scale signal and the brightness; and inputting the compensated gray-scale signals to the pixel points to cause the pixel points to display with the compensated brightness, respectively.

8. The brightness compensation method for pixel point of claim 3, further comprising: storing the compensation parameters into a drive controller of the display screen after obtaining the compensation parameters at an end of each measurement process.

9. The brightness compensation method for pixel point of claim 8, wherein the compensation parameters obtained during the $(i)^{th}$ measurement process overlay the compensation parameters obtained during the $(i-1)^{th}$ measurement process.

10. The brightness compensation method for pixel point of claim 3, wherein the number of the plurality of gray-scale signals input to the display screen during each measurement process is one of 2 to 8.

11. A non-transitory computer readable-storage medium on which computer executable instructions are stored, wherein when the computer executable instructions are executed by one or more processors, the computer executable instructions causes the one or more processors to perform a brightness compensation method for pixel point, the brightness compensation method comprising: when an $(i)^{th}$ measurement process is executed and $1 \le i \le N$ and N is an integer greater than 1, sequentially inputting a plurality of gray-level signals to a display screen, obtaining images displayed on the display screen under the plurality of gray-scale signals, and extracting brightness of pixel points in the images under the plurality of gray-scale signals;

determining a reference pixel point from the pixel points, and calculating difference parameters between the brightness of the pixel points and the brightness of the reference pixel point under the plurality of gray-scale signals;

fitting the difference parameters of the pixel points with initial brightness of the pixel points under the plurality of gray-level signals, respectively, to obtain initial brightness-difference parameter curves of the pixel points, wherein the initial brightness of the pixel points is obtained in a first measurement process under the plurality of gray-scale signals; and calculating compensation parameters of the pixel points based on the initial brightness-difference parameter curves of the pixel points, wherein during the $(i)^{th}$ measurement process, i=2 to N, images displayed on the display screen under the plurality of gray-level signals are obtained by compensating the initial brightness of the pixel points under the plurality of gray-level signals based on the compensation parameters obtained during an $(i-1)^{th}$ measurement process.

12. The non-transitory computer readable-storage medium of claim 11, wherein the calculating difference parameters between the brightness of the pixel points and the brightness of the reference pixel point under the plurality of gray-scale signals, comprises:

recording the number of the plurality of gray-scale signals, input sequentially to the display screen during each measurement process, when M is an integer greater than 1, and the number of the pixel points in the display screen being D, when D is an integer greater than 1;

calculating the difference parameters of each of the pixel points based on the following formula (1):

$$L_j^r = Q_{x,j} * L_{x,j} \quad (1)$$

wherein j=1 to M; x=1 to D; $L_j^r$ is a brightness of the reference pixel point under a $(j)^{th}$ gray-scale signal; $L_{x,j}$ is a brightness of an $(x)^{th}$ pixel point under the $(j)^{th}$ gray-scale signal; $Q_{x,j}$ is a difference parameter between the brightness of the $(x)^{th}$ pixel point and the brightness of the reference pixel point under the $(j)^{th}$ gray-scale signal.

13. The non-transitory computer readable-storage medium of claim 12, wherein the fitting the difference parameters of the pixel points with initial brightness of the pixel points under the plurality of gray-scale signals comprises fitting the difference parameters of the pixel points with initial brightness of the pixel points under the plurality of gray-scale signals comprises by linear function fitting; and the calculating compensation parameters of the pixel points based on the initial brightness-difference parameter curves of the pixel points comprises:

expressing the initial brightness-difference parameter curve of each of the pixel points by the following formula (2):

$$Q_x = K_x' * L_x^0 + K_x'' \quad (2)$$

wherein Q is the difference parameter between the brightness of the $(x)^{th}$ pixel point and the brightness of the reference pixel point under a gray-scale signal; $L_x^0$ is the initial brightness of the $(x)^{th}$ pixel point under the gray-scale signal; and $K_x'$ and $K_x''$ are coefficients;

calculating a value of $K_x'$ as a first compensation parameter of the $(x)^{th}$ pixel point and a value of $K_x''$ as a second compensation parameter of the $(x)^{th}$ pixel point.

14. The non-transitory computer readable-storage medium of claim 12, wherein the compensating the initial brightness of the pixel points under the plurality of gray-scale signals comprises:

calculating compensated brightness of each of the pixel points under the plurality of gray-scale signals based on the following formula (3):

$$L_{x,j} = K_x' * (L_{x,j}^0)^2 + K_x'' * L_{x,j}^0 \quad (3)$$

wherein $L_{x,j}$ is the compensated brightness of the $(x)^{th}$ pixel point under the $(j)^{th}$ gray-scale signal; $L_{x,j}^0$ is the initial brightness of the $(x)^{th}$ pixel point under the $(j)^{th}$ gray-scale signal; and $K_x'$ and $K_x''$ are compensation parameters obtained in the $(i-1)^{th}$ measurement process;

obtaining compensated gray-scale signals of the pixel points corresponding to the compensated brightness under the plurality of gray-scale signals based on a correspondence between a gray-scale signal and a brightness; and converting multiple gray-scale signals, which are intended to be sequentially input to the display screen, into compensated gray-scale signals for the pixel points, such that the pixel points display with the compensated brightness, respectively.

15. The non-transitory computer readable-storage medium of claim 12, wherein the brightness compensation method further comprises: during an actual display of the display screen, obtaining uncompensated brightness of the pixel points in an image to be displayed on the display screen;

retrieving the compensation parameters obtained during the $(N)^{th}$ measurement process;

calculating compensated brightness of each of the pixel points based on the following formula (4):

$$L_x = K_{x,N}' * (L_x^0)^2 + K_{x,N}'' * L_x^0 \quad (4)$$

wherein $L_x$ is the compensated brightness of the $(x)^{th}$ pixel point; $L_x^0$ is the uncompensated brightness of the $(x)^{th}$ pixel point; $K_{x,N}'$ is a first compensation parameter of the $(x)^{th}$ pixel point obtained during the $(N)^{th}$ measurement process; $K_{x,N}''$ is a second compensation parameter of the $(x)^{th}$ pixel obtained during the $(N)^{th}$ measurement process;

obtaining the compensated gray-scale signals of the pixel points corresponding to the compensated brightness based on the correspondence between the gray-scale signal and the brightness; and inputting the compensated gray-scale signals to the pixel points to cause the pixel points to display with the compensated brightness, respectively.

16. The non-transitory computer readable-storage medium of claim 11, wherein the brightness compensation method further comprises: storing the compensation parameters into a drive controller of the display screen after obtaining the compensation parameters at an end of each measurement process.

17. The non-transitory computer readable-storage medium of claim 16, wherein the compensation parameters obtained during the $(i)^{th}$ measurement process overlay the compensation parameters obtained during the $(i-1)^{th}$ measurement process.

18. The non-transitory computer readable-storage medium of claim 11, wherein the number of the plurality of gray-scale signals input to the display screen during each measurement process is one of 2 to 8.

* * * * *